US005665160A

United States Patent [19]

Davene et al.

[11] Patent Number: 5,665,160

[45] Date of Patent: Sep. 9, 1997

[54] AIR KNIFE DEVICE FOR REGULATING THE THICKNESS OF A DEPOSIT

[75] Inventors: Jean Davene, Paris; Laurent Dondin, Saint Aignan de Grandlieu, both of France

[73] Assignee: Kvaerner Clecim, St.-Christophe, France

[21] Appl. No.: 548,393

[22] Filed: Oct. 26, 1995

[30] Foreign Application Priority Data

Oct. 27, 1994 [FR] France ..... 94 12908

[51] Int. Cl.[6] ..... B05C 11/06

[52] U.S. Cl. ..... 118/63; 118/62; 118/58; 118/65; 427/349; 427/431; 427/434.2; 427/435

[58] Field of Search ..... 118/62, 63, 58, 118/65, 68; 427/349, 369, 431, 434.2, 435

[56] References Cited

FOREIGN PATENT DOCUMENTS 54-93638 7/1979 Japan .

*Primary Examiner*—Donald E. Czaja

*Assistant Examiner*—Steven B. Leavitt

*Attorney, Agent, or Firm*—Pollock, Vande Sande & Priddy

[57] ABSTRACT

An air knife device for regulating the thickness of a layer deposited on a strip at the output of a bath, comprising at least one nozzle defined by two lips spaced a small distance apart, the nozzle being supplied with pressurized fluid in order to blow at least one flat jet of fluid onto the strip. The device is associated with at least one fluid cushion stabilizer arranged on at least one side of the nozzle along one of its lips and comprising a substantially flat wall extending from this lip in a direction substantially parallel to the strip so as to define a thin, flat space between the wall and the strip. A fluid is introduced into this space for the formation of a fluid cushion which is able to stabilize the vibrations of the strip.

8 Claims, 1 Drawing Sheet

AIR KNIFE DEVICE FOR REGULATING THE THICKNESS OF A DEPOSIT

FIELD OF THE INVENTION

This invention relates to an air knife device for regulating the thickness of a layer of a protective product deposited on a strip at the output of a bath of liquid product and applies in particular to metal strip galvanizing installations.

BACKGROUND OF INVENTION

A galvanizing installation comprises, in a general way, a bath of molten metal such as zinc through which the metal strip is continuously fed. A the output of the bath, the strip is covered, on both of its faces, by a metal deposit. It is necessary to regulate the thickness of the metal layer thus deposited, and, to this end, use is generally made, on at least one face of the strip, of an air knife regulating device which is used to blow a flat jet of fluid onto the strip in a direction substantially perpendicular to it. To produce a flat jet, use is generally made of a blower nozzle supplied with pressurized liquid and provided with a rectangular opening defined by two lips spaced a small distance apart and extending across the entire width of the strip. The thickness of the coating depends on the distance between the nozzle and the strip and on the pressure exerted by the jet, it being possible to regulate the latter by modifying the spacing of the lips.

The geometry of the line and the conditions for implementing the process, such as the zinc solidification method, and the stresses of the strip cause the sheet to vibrate at relatively erratic amplitude and frequency. These vibrations, whose amplitudes can exceed ten millimeters, result in variations in thickness which are incompatible with quality requirements, and additional costs due to the overconsumption of zinc.

This metal being, generally, expensive, it is desirable to limit the thickness of the deposit to the desired value.

To reduce the vibrations, one approach would be to act on the traction of the strip or on the arrangement of the rollers, or to place dampening means, for example of the pneumatic or magnetic kind, along the sheet. Such means, however, complicate the installation and are, in any case, relatively expensive.

It has also been proposed to stabilize the strip leaving the bath by means of two fluid cushions by providing, on each side of the strip and above the nozzles, a flat space defined by a flat wall parallel to the strip and in which a fluid is injected under pressure which then escapes from the two ends of the space and forms, on the upstream side, an overpressure zone. Such a device must, however, be spaced a certain distance from the nozzles, which reduces its effectiveness. Moreover, it is difficult to correctly adjust the pressure of the fluids injected on either side of the strip.

It has also been proposed in (JP-A-54.93638) to extend the upper lip of the nozzle, on the downstream side in relation to the strip feed direction, by a guide wall for guiding the fluid blown by the nozzle, so as to form a fluid cushion. The wall extending along the strip is corrugated so as to form successive zones in which the pressure is progressively reduced. However, turbulence may form above the upper lip causing a depression that can lead to the strip sticking to the upper lip.

The arrangements known to date for dampening the vibrations were therefore relatively complex and expensive and difficult to implement and, moreover, it was difficult to adjust the pressures in the fluid cushions to the entire satisfaction of users.

SUMMARY OF THE INVENTION

The object of the invention is a very simple device, easy to implement and particularly efficient, which acts immediately at the air knife level and can, in addition, thanks to its small spatial requirements, be fitted to existing installations without any significant modification thereof.

The invention therefore applies, in a general way, to an air knife regulating device comprising at least one blower nozzle defined by two lips spaced a small distance apart and defining an elongated opening extending at least across the entire width of the strip, and means for supplying the nozzle with pressurized fluid in order to blow a flat jet of fluid onto the strip in a direction at right angles to it.

According to the invention, the air knife device is associated with at least one means for stabilizing vibrations, comprising at least one substantially flat wall, arranged at least on the downstream side of the nozzle in relation to the feed direction and extending in a direction substantially parallel to the strip and over a length starting from an inside edge arranged along the corresponding lip of the nozzle and at a small distance from it, in such a way as to define an elongated orifice, the wall being spaced from the strip by a small distance in relation to its length, so as to define, between the wall and the strip, a flat space in which an additional fluid is introduced which passes through the elongated orifice and mixes in the flat space with a portion of the fluid blown by the nozzle, so as to form in the flat space a fluid cushion which is able to stabilize the vibrations of the strip.

The flat wall defining the flat space into which the stabilizing fluid is introduced extends across the entire width of the strip and over a sufficient length to ensure the stabilization of the strip, taking into account the pressure of the fluid.

According to a particularly simple and advantageous embodiment, the elongated orifice for introducing the fluid into the stabilizing cushion is linked to a fluid supply chamber placed along the wall, on the side facing the strip, and which can advantageously open directly to the atmosphere so that the stabilizing fluid is formed by the air which freely enters the supply chamber and is sucked by the pressurized fluid jet blown by the nozzle and deviated. by the strip.

According to a preferred embodiment, the distance between the wall and the strip is slightly greater than the distance between the outlet of the nozzle and the strip, so as to provide a small recess which promotes the suction of air through the rectangular orifice.

Normally, the blower nozzle will be located a small distance from the surface of the metal bath and the stabilizing cushion provided above the nozzle, i.e, on its downstream side in relation to the strip feed direction.

BRIEF DESCRIPTION OF THE DRAWINGS

The installation will be better understood from the following detailed description of an embodiment of the invention, given by way of example and shown in the attached drawings.

Figure 1:
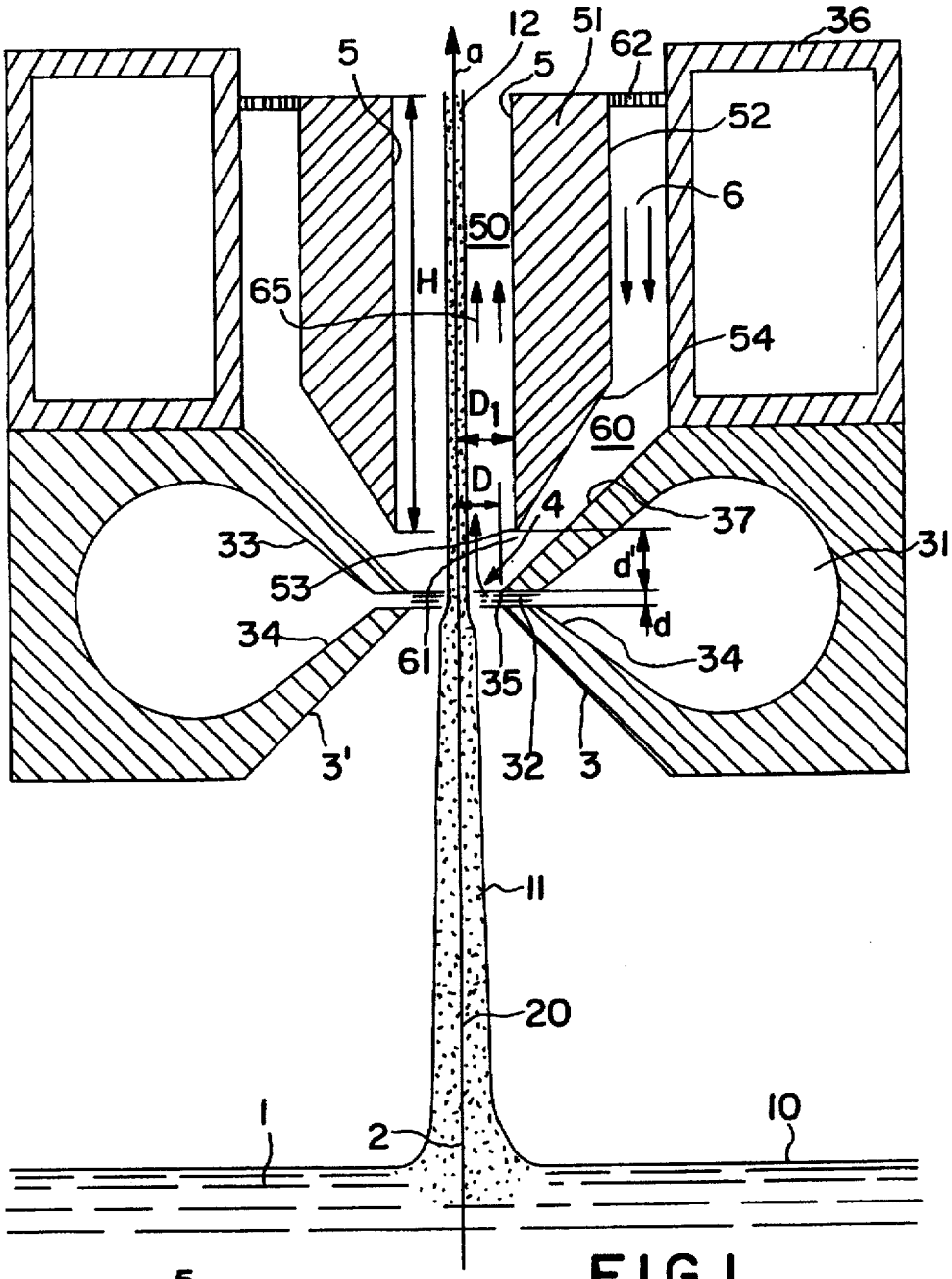
FIG. 1 shows schematic overall cross sectional view of the air knife thickness regulating device according to the invention.
Figure 2:
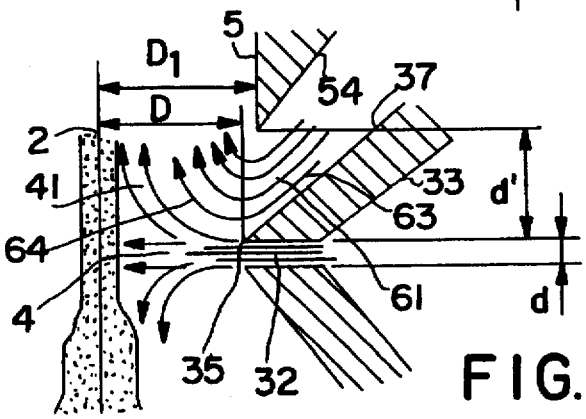
FIG. 2 is a detail view on a larger scale.

A strip processing installation such as an immersed galvanizing line comprises, in a general way, a bath 1 of molten metal, such as zinc, through which a metal strip 2 is made to pass and which leaves the bath in a substantially vertical direction 20. Such means are well known and are not therefore shown in the drawings.

A layer 11 of liquid metal is deposited, by adherence, on the two faces of the portion 20 of the strip leaving the bath. To respect the quality requirements imposed on the product and to limit the quantity of metal consumed to only that strictly necessary, an air knife thickness regulating device is generally placed at a relatively small distance above surface 10 of bath 1. The regulating device comprises two nozzles 3, 3', located respectively on either side of the strip 20 and each having a chamber forming a collector 31 supplied with a fluid under pressure, for example air, and provided, on the side facing strip 20 with an outlet opening 32 defined an upper lip 33 and a lower lip 34. These lips extend at least across the full length of the strip and therefore define an elongated opening having a height d equal to the spacing between the two lips 33, 34, and a length at least equal to, and preferably, a little greater than, the width of the strip 2.

A flat jet 4 of pressurized fluid therefore is formed in opening 32, substantially perpendicular to the direction of feed of strip 20, and which exerts a pressure on strip 2 which can be modulated by varying the width of orifice 32, i.e, the spacing between lips 33 and 34. To this end, one of the two lips is generally movable.

When the two lips 33, 34 are substantially parallel, opening 32 is rectangular, but it is also possible to vary the spacing of the lips across the width of the strip, the width d of the opening 32 being, for example, slightly narrower in the central portion than on the edges.

Such devices are well known and do not require discussion.

The thickness of the layer 12 deposited on the two faces of the strip 2 depends, notably, on the pressure of the fluid blown, on the width d of opening 32 and on the distance D between the edges 35 of the two lips and the strip 2, and these parameters must therefore be, as far as possible, kept constant to ensure the evenness of the deposit.

In most cases, two symmetrical nozzles 3, 3' are used, whose effects mutually balance out, but it is difficult to avoid vibrations of strip 2 which feeds at high speed and, consequently, variations in distance D and in the thickness of the deposit 12.

The invention provides a very simple vibration stabilizing device associated with each nozzle 3, which device essentially comprises a flat wall 5 which extends from nozzle 3 in a direction parallel to strip 20 leaving the bath, and spaced from said strip 20 by a small distance D1 so as to provide, along strip 2, a flat space 50 extending across the entire width of strip 2 and over a height H, immediately downstream of the nozzle 3 in relation to the feed direction of the strip.

Generally, wall 5 is rectangular, but other elongated forms can also be used.

Wall 5 is provided on the side of a supporting piece 51 fixed, for example, onto a beam 36 which supports the nozzle 3. Side 52 of piece 51 facing support 36 is separated from the support by a space so as to form a chamber 6 which leads into an orifice 61 located in the lower portion of wall 5, immediately above the corresponding lip 33 of nozzle 3. For example, in the simplest embodiment shown in the drawing, inner edge 53 of wall 5 is spaced apart by a distance d' from the end 35 of lip 33 so as to define a substantially rectangular orifice of height d' extending above nozzle 3, across the entire width of opening 32. The side 52 of supporting piece 51 is extended by a portion 54 which extends along the corresponding wall 37 of nozzle 3 and comes progressively closer to the wall so that supply channel 60 thus defined progressively narrows up to outlet orifice 61. Moreover, chamber 6 formed between wall 51 and support 36 of the nozzle opens directly to the atmosphere through a wide open orifice which, if need arises, can easily be fitted with a filter.

It is known that a jet of fluid blown at high speed in a space tends to suck in the surrounding air. This phenomenon occurs in the device of the invention since the jet of pressurized fluid 4 blown at high speed towards strip 20 divides into two parts which deviate upwardly and downwardly, the upwardly deviated part 41 passing in front of orifice 61 and sucking air 62 located in chamber 6 and which can be continuously renewed by introduction through upper opening 55. The air flow 33 thus sucked can, moreover, accelerate in convergence 60. The additional air 64 sucked through opening 61 and then mixing with the part 41 of the upwardly deviated pressurized fluid expands in flat space 50 defined on one side by wall 5 and on the other by strip 2 and forms a fluid cushion 65 which makes it possible to dampen and even eliminate the vibrations of strip 2. The length of the fluid cushion, which corresponds to the height H of wall 5 is determined so as to ensure stabilization of the strip, taking into account the pressure which can be given to fluid 65 and the amplitude of the vibrations to be dampened.

For example, the width d' of orifice 61 can be approximately ten times the width d of blower nozzle 32, and height H of the wall 5 will be at least 250 mm in conventional installations.

Preferably, the distance D1 between wall 5 and strip 20 will be slightly greater than the distance D between edge 35 of nozzle 3 and strip 20 so as to form a small recess to promote the suction of air through orifice 61, this recess being in the order of 2 to 5 mm for example.

In certain cases, it is possible to vary the orientation of the fluid knife with respect to the strip by pivoting the nozzle, but it is preferable that wall 5 be independent of the orientation of the nozzle and remain essentially parallel to the strip 20 in order to better provide the fluid cushion effect sought.

Two nozzles 3, 3' are used in most cases, these nozzles being placed symmetrically on either side of portion 20 of strip 2 leaving the bath and each advantageously being associated with a stabilizing wall 5, 5'. In this case, the two fluid cushions located on either side of the strip mutually balance out and ensure immediate dampening of vibrations. However, in the simplest devices, it would be possible to use a single fluid cushion on one side only of the strip.

Blower nozzles 3 and 3' have only been shown schematically since the invention has the advantage of requiring only a fairly small modification to be made to the nozzle and may therefore be applied to any type of known nozzle.

Moreover, it is not indispensable for the stabilizing fluid cushion to extend continuously across the entire width of the strip. Indeed, it is possible to associate each blower nozzle 3 with several walls shorter wall 5 forming fluid cushions that are spaced apart from each other.

The stabilizing device Just described provides a means of dampening vibrations of the strip both in the transverse direction and in the longitudinal feed direction.

We claim:

1. An air knife device for regulating the thickness of a layer of a protective product deposited on a strip leaving a product bath in a feed direction, said device comprising:

(a) at least one blower nozzle arranged over at least one downstream side of the strip and defined by two lips spaced a small distance apart and defining at least one first elongated orifice extending at least across an entire width of the strip;

(b) means for feeding the nozzle with a pressurized fluid in order to blow at least one flat fluid jet onto the strip at right angles to the strip;

(c) at least one flat wall arranged on at least one side of the nozzle in the feed direction and extending substantially parallel to the strip and over a length from an inside edge arranged along the corresponding lip of the nozzle and a small distance from it, so as to define at least one second elongated orifice, the flat wall being spaced apart from the strip by a small distance with respect to the length so as to define a flat space between said wall and the strip; and (d) means for introducing an additional fluid into said flat space by passing through said second elongated orifice, said additional fluid mixing in said flat space with a portion of the fluid blown by the nozzle to form in said flat space a fluid cushion which is able to stabilize vibrations of the strip.

2. The device according to claim 1, wherein the length of the flat wall defining the space is determined to ensure stabilization of the strip, taking into account the amplitude of the vibrations to be dampened, according to a pressure that the additional fluid can reach in said space.

3. The device according to claim 2, wherein the second elongated orifice for introducing the additional fluid into the elongated space is linked to a fluid supply chamber, located along the wall on the side facing the strip, through a channel which progressively narrows, in transverse section, up to the second elongated orifice.

4. The device according to claim 3, whereto the stabilizing fluid consists of air passing freely into the space formed along the flat wall on the side facing the strip, and which opens directly to atmosphere, so as to form the fluid supply chamber, said air being suctioned by the pressurized flat fluid blown through the nozzle and deviated by the strip by passing in front of an inlet orifice, a deviated portion of the fluid blown through the nozzle mixing with the suctioned air to form a stabilizing cushion.

5. The device according to claim 4, wherein the distance between the wall and the strip is slightly greater than the distance between the outlet of the nozzle and the strip so as to provide a small recess that encourages suction of air through the inlet orifice.

6. The device according to claim 1, wherein the flat wall extends across the entire width of the nozzle so as to form a single stabilizing cushion.

7. The device according to claim 1, wherein the blower nozzle is associated with at least two stabilizing walls adjacent to each other and each extending along a portion of the corresponding lip so as to form at least two stabilizing cushions spaced along the same nozzle.

8. The device of claim 1, comprising two blower nozzles located symmetrically on either side of the strip, wherein each blower nozzle is associated with at least one wall for the production of a stabilizing fluid cushion associated with each nozzle.

* * * * *